United States Patent [19]

Hernandez

[11] 4,092,879

[45] June 6, 1978

[54] SCREW BACK REMOVAL TOOL

[75] Inventor: Gilbert Villanueva Hernandez, San Jose, Calif.

[73] Assignee: National Semiconductor Corporation, Santa Clara, Calif.

[21] Appl. No.: 767,300

[22] Filed: Feb. 10, 1977

[51] Int. Cl.[2] ..... G04D 3/00; B25B 13/18

[52] U.S. Cl. ..... 81/6; 81/128

[58] Field of Search ..... 81/6, 128; 29/283

[56] References Cited

U.S. PATENT DOCUMENTS

| | | | |
|---|---|---|---|
| 3,445,913 | 5/1969 | Piquerez | 81/6 X |

FOREIGN PATENT DOCUMENTS

| | | | |
|---|---|---|---|
| 912,069 | 4/1946 | France | 81/6 |
| 1,216,072 | 4/1960 | France | 81/6 |
| 922,554 | 4/1963 | United Kingdom | 81/6 |

*Primary Examiner*—James L. Jones, Jr.
*Assistant Examiner*—James G. Smith
*Attorney, Agent, or Firm*—Brown & Martin

[57] ABSTRACT

A self adjusting spanner wrench for screw type watch backs comprises a generally cylindrical body member having sings at one end and a plurality of adjustable gripper members extending from the opposite end and includes cam means internally of the body member for engaging the plurality of grippers for camming them radially inward for gripping a watch back or the like upon axial movement of the body member with respect to the gripping members.

12 Claims, 5 Drawing Figures

SCREW BACK REMOVAL TOOL

BACKGROUND OF THE INVENTION

The present invention relates to hand tools and pertains particularly to a self adjusting spanner wrench for removal of screw type watch backs.

Most wrist watch backs are threadably secured to the back of the watch case to provide a more secure and water tight closure thereof. Watches are typically produced in many different sizes and accordingly a separate tool is generally required for the removal of each size watch back. This requires that a watch repairman have on hand a separate tool for each watch.

Accordingly it is desirable that a self adjusting spanner wrench be available for the removal of backs of watches.

SUMMARY AND OBJECTS OF THE INVENTION

Accordingly it is the primary object of the present invention to overcome the above problems of the prior art.

Another object of the present invention is to provide an improved self adjusting spanner wrench for use on screw type watch backs and the like.

In accordance with the primary aspects of the present invention, a self adjusting spanner wrench for use on screw type watch backs includes a main body member having a plurality of gripper elements extending from one end thereof and disposed in camming grooves in the body member such that movement of the gripping members with respect to the body cams the grippers into gripping engagement with an element to be gripped and rotated.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
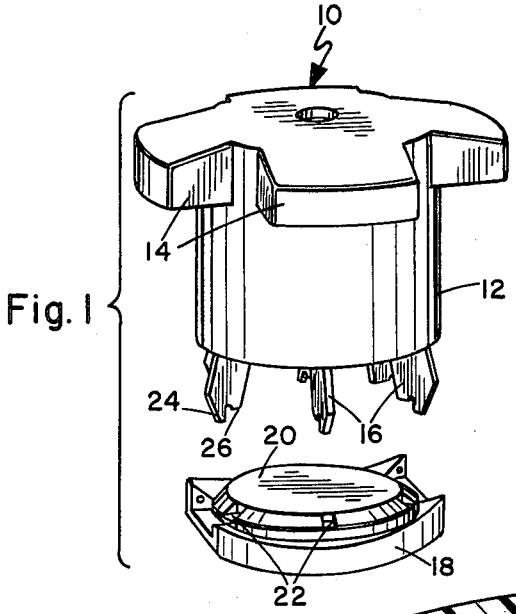
FIG. 1 is a perspective view of the tool positioned over a typical watch.

Turning now to the drawing, particularly FIG. 1, there is illustrated a tool in accordance with the present invention designated generally by the numeral 10, and comprising a generally cylindrical body member 12 having a plurality of wings 14 on the upper end thereof. A plurality of gripper elements 16 extend outward from the opposite end of the tool from the wing members. The wing members are to provide means for readily grasping the tool in the hand for rotation and the like.

Shown directly below the tool in FIG. 1 is a watch 18 of substantially conventional design having a back 20 which is rotatably secured to the watch housing. The back includes a plurality of slots 22 for receiving a spanner wrench for removal and tightening of the back.

The tool 10 of the present invention is designed to adjust to many different sizes of watches and to readily and conveniently grasp and rotate the cack of such watches.

Figure 2:
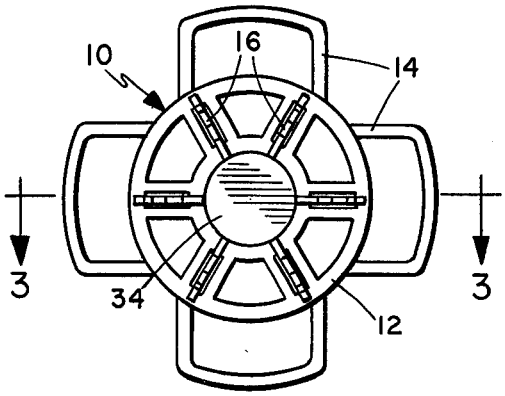
FIG. 2 is an underside view of the tool.
Figure 5:
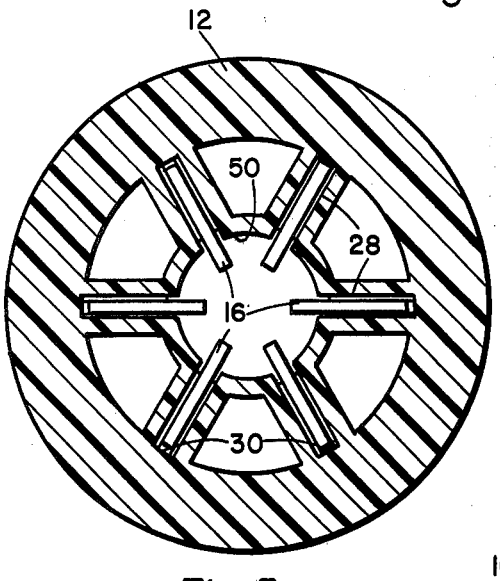
FIG. 5 is a sectional view taken on line 5—5 of FIG. 3.

As best seen in FIG. 2, it will be noted that the gripper members 16 are disposed about the axis of the main body member 12. These gripper members, as will be more fully appreciated from FIGS. 3 through 5, for example, each include a prong 24 at the outer end thereof and an adjacent stop surface 26. These gripper members are each mounted within a slit 28 formed inside the body member 12. Each of the slots include outer camming surface 30 and an inner camming surface 32. The inner camming surface 32 is defined by a retaining plug 34, also serving to retain the grippers in the slots. The gripper members 16 are mounted within the slots in body member 12 for reciprocal movement along the axis thereof and simultaneous radial movement with respect to the axis. This movement is generated by engagement of the cam surfaces 30 and 32 with the sides of the gripper members 16.

Figure 3:
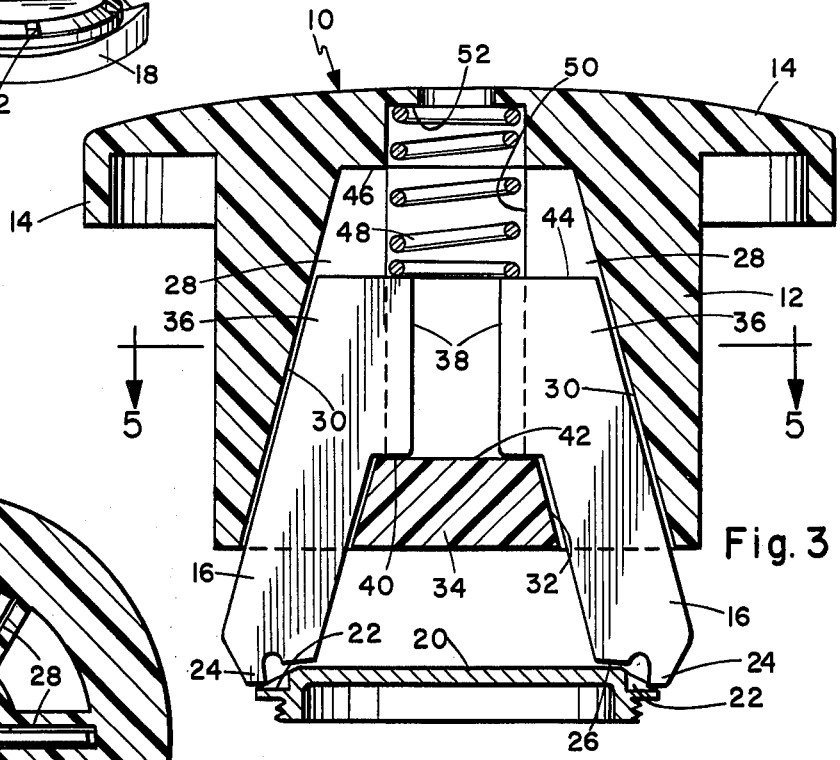
FIG. 3 is an enlarged sectional view taken on line 3—3 of FIG. 2, showing the tool in initial position on a watch back.
Figure 4:
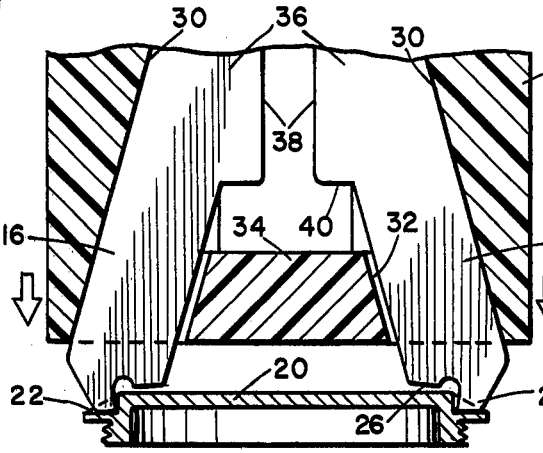
FIG. 4 is a similar sectional view showing the tool locked into the watch back.

The gripper members extend outward at an angle to the axis of the body member 12 and each include an inner body portion 36 which includes a inner edge 38 extending parallel to the axis of the housing and a stop portion or edge 40 extending transverse or at right angles to the housing for engaging an abutting surface 42 on the retainer plug on member 34. An inner end 44 of the gripper member is adapted to engage an inner wall surface 46 of the housing 12. A suitable biasing means such as a coil spring 48 is mounted within a bore 50 coaxial with the axis of the housing, and abutts the end wall 52 of the bore 50 and the ends 44 of each of the respective gripper members 16. This biases the gripper means to the outermost or extended positions as shown in FIG. 3. Simultaneously, these gripper members are cammed outward to their open or outermost position away from the axis of the body or housing member 12. Thus, when the gripper members are moved axially of the housing away from the wing end portion they are cammed outward to their outermost open position. Conversely when they are forced inward toward the wing end of the housing the gripper members are cammed inward toward the axis of the housing and into the gripping position as shown, for example, in FIG. 4.

Thus, in operation the spanner wrench is placed on the back of a watch as shown in FIG. 3 and the housing or body member 12 moved axially toward the watch back for camming the gripper members 16 radially inward forcing prongs 24 into the slots 22 on the back 20. The tool or wrench may then be rotated for rotation of the watch back for either removing or attaching it to the back of a watch.

Upon release of axial pressure on the tool the spring 48 biases the gripping members 16 axially along the axis of the housing 12 thus camming them radially outward out of engagement with the slots 22 of the watch back 20.

While the present invention has been described and illustrated by means of specific embodiment, it is to be understood that numerous changes and modifications may be made therein without departing from the spirit and scope of the invention as defined in the appended claims.

Having described my invention, I now claim:

1. A self adjusting spanner wrench comprising:

a generally cylindrical body having a handle end and a gripper end, a plurality of guide slots formed in said body and extending axially and radially thereof, and including cam means defined by each of said slots, a gripper member slideably mounted in each of said slots and including a gripper prong extending from the gripper end of said body, said gripper member disposed in engagement with said cam means, for radial movement in response to said cam means upon axial movement within said slot, and biasing means within said body for biasing said gripper members to the outermost position in said guide slots.

2. The wrench of claim 1, wherein said cam means includes inner cam means for camming said gripper member outward away from the axis of said body upon movement toward said gripper end.

3. The wrench of claim 1, wherein said gripper members extend outward from said body member at an angle to the axis thereof.

4. The wrench of claim 1, wherein said biasing means comprises a coil spring disposed in said body and engaging the inner end of said gripper members.

5. The wrench of claim 1, wherein said gripper members include a shoulder for abutting a retainer member within said housing.

6. The wrench of claim 1, wherein said housing includes a plurality of wing members on the handle end thereof.

7. The wrench of claim 2, wherein said cam means comprises sloping inner and outer walls within said body member defined by walls of said grooves extending outward at an angle to the axis of said body member.

8. The wrench of claim 2, wherein said gripper members extend outward from said body member at an angle to the axis thereof.

9. The wrench of claim 8, wherein said biasing means comprises a coil spring disposed in said body and engaging the inner end of said gripper members.

10. The wrench of claim 9, wherein said gripper members include a shoulder for abutting a retainer member within said housing.

11. The wrench of claim 9, wherein said cam means comprises sloping inner and outer walls within said body member defined by walls of said grooves extending outward at an angle to the axis of said body members.

12. The wrench of claim 11, wherein said housing includes a plurality of wing members on the handle end thereof.

* * * * *